US005855159A

United States Patent [19]

Yoshida et al.

[11] Patent Number: 5,855,159

[45] Date of Patent: Jan. 5, 1999

[54] HYDRAULIC CIRCUIT FOR A BOOM CYLINDER IN A HYDRAULIC SHOVEL

[75] Inventors: Nobumi Yoshida; Nobuhisa Honda, both of Tochigi-ken, Japan

[73] Assignee: Komatsu Ltd., Japan

[21] Appl. No.: 793,045

[22] PCT Filed: Aug. 28, 1995

[86] PCT No.: PCT/JP95/01704

§ 371 Date: Feb. 18, 1997

§ 102(e) Date: Feb. 18, 1997

[87] PCT Pub. No.: WO96/06988

PCT Pub. Date: Mar. 7, 1996

[30] Foreign Application Priority Data

Aug. 30, 1994 [JP] Japan ..... 6-205206

[51] Int. Cl.[6] ..... F15B 11/08

[52] U.S. Cl. ..... 91/451; 91/466

[58] Field of Search ..... 91/451, 466, 468, 91/452; 60/469, 403; 137/596

[56] References Cited

U.S. PATENT DOCUMENTS

| | | | |
|---|---|---|---|
| 3,948,146 | 4/1976 | Maurer et al. | 91/451 X |
| 4,282,898 | 8/1981 | Harmon et al. | 91/451 X |
| 4,794,846 | 1/1989 | Von Der Ley et al. | 91/451 |
| 5,063,742 | 11/1991 | Yoshimatsu | 60/466 |

FOREIGN PATENT DOCUMENTS

| | | | |
|---|---|---|---|
| 1-92501 | 6/1989 | Japan | F15B 11/02 |
| 1-119445 | 8/1989 | Japan | E02F 3/43 |
| 6-1465 | 1/1994 | Japan | E02F 9/22 |
| 1477954 A | 5/1989 | U.S.S.R. | 91/451 |

*Primary Examiner*—John E. Ryznic

*Attorney, Agent, or Firm*—Rader, Fishman & Grauer; Ronald P. Kananen

[57] ABSTRACT

A hydraulic circuit for a boom cylinder in a hydraulic shovel has a pressurized discharge fluid from a hydraulic pump that is driven by an engine, the pressurized discharge fluid supplied via a directional control valve for a boom into a retraction pressure chamber and an extension pressure chamber of a boom cylinder for swinging the boom upwards and downwards. A relief valve is included in a circuit for connecting the retraction pressure chamber of the boom cylinder to the boom directional control valve, the relief valve having a relief set pressure. A switching device is included for switching the relief set pressure to a low pressure as well as to a high pressure if the directional control valve is set at a position that is other than a neutral position thereof, when the engine is driven, the switching device being adapted to switch the relief set pressure to a high pressure when the engine is halted.

7 Claims, 4 Drawing Sheets

HYDRAULIC CIRCUIT FOR A BOOM CYLINDER IN A HYDRAULIC SHOVEL

TECHNICAL FIELD

The present invention relates to a hydraulic circuit for supplying a pressurized discharge fluid from a hydraulic pump into a boom cylinder in a hydraulic shovel.

BACKGROUND ART

A hydraulic shovel has hitherto been known as shown, for example, in FIG. 1 of the drawings attached hereto. In such a hydraulic shovel, a lower vehicle body 2 that is equipped with a traveling body 1 has an upper vehicle body 3 mounted thereon as turnable, the said upper and lower vehicle bodies 2 and 3 constituting a vehicle body 4. A boom 5 is attached onto the said upper vehicle body 3 so as to be swung upwards and downwards by means of a boom cylinder 6. A forward end of the said boom 5 has an arm 7 attached thereto so as to be swung upwards and downwards by means of an arm cylinder 8. A forward end of the said arm 7 has a bucket 9 attached thereto so as to be turnable up and down by means of a bucket cylinder 10. Thus, the hydraulic shovel has been so configured that each of the boom 5 and the arm 7 may be swung upwards and downwards and the bucket 9 may be turned upwards and downwards, and has been used to perform an excavating operation.

A hydraulic circuit for such a hydraulic shovel is generally designed to supply a pressurized discharge fluid from a hydraulic pump into the boom cylinder 6, the arm cylinder 8 and the bucket cylinder 10 via a boom directional control valve, an arm directional control valve and a bucket directional control valve, respectively, to effect an extension and a retraction operation for each of these cylinders.

While an excavating operation is being carried out with a bucket with each of the cylinders expansion and retraction operated as shown in FIG. 1, it can be seen that if the load of excavation is increased due to the presence of a rock in the ground being excavated, the boom 5, the arm 7 and the bucket 9 will cease moving and will be made incapable of continuing the excavating operation. Then, it will become necessary to effect an extension operation for the boom cylinder 6 by acting on the boom directional control valve to swing the boom 5 upwards, thereby displacing the bucket 9 upwards.

Thus, since if a large load of excavation is encountered, it becomes necessary to operate the boom directional control valve to displace the bucket 9 upwards in the conventional hydraulic circuit, the operating efficiency has hitherto been poor and since the vehicle body is then flapped, the operation has also been burdensome for the operator.

In order to resolve these problems, it has been suggested that as shown in FIG. 1, a relief valve 14 having a low relief set pressure (relief-operating at a low pressure) should be provided in a circuit that connects the retraction pressure chamber 11 of the boom cylinder 6 to the boom directional control valve 12. The boom directional control valve 12 will then be switched from its neutral position a to its retraction position b to supply a pressurized discharge fluid of a hydraulic pump 15 into the retraction pressure chamber 11 of the boom cylinder 6. During an excavating operation, if the excavating load is increased whereby the pressure within the first circuit 13 reaches the above mentioned relief set pressure, the pressure fluid in the retraction pressure chamber 11 of the boom cylinder 6 will be allowed to flow out through the relief valve 14 into a reservoir 16. As a result, a situation may be eliminated in which the boom 5 will no longer be swung downwards, and the boom 5, the arm 7 and the bucket 9 will altogether cease moving.

If such a measure is undertaken, however, the pressure within the retraction pressure chamber 11 of the boom cylinder 6 can only be elevated up to the relief set pressure of the relief valve 14. Then, the force by which the boom 5 is swung downwards will be reduced.

For this reason, problems arise such as the inability to lift up the vehicle body 4 with one end portion 1*a* of the traveling body 1 serving as a supporting point by swinging the boom 5 downwards to press the bucket 9 against the ground surface and the inability to obtain a sufficient force of excavation if a strong force of excavation is required. Thus, it has been recognized that there is an undesirable limitation in establishing the low pressure for the relief set pressure of the relief valve 14; hence there is an undesirable limitation in enhancing the operating efficiency of excavation.

In an attempt to overcome these problems, a hydraulic circuit has been proposed, as disclosed in Japanese Utility Model Unexamined Publication No. Hei 6-1465, in which the relief set pressure of the above mentioned relief valve 14 should be switched between a high pressure and a low pressure.

If such a hydraulic circuit is adopted, the relief set pressure of the relief valve 14 can be set at a low pressure during an excavating operation to enhance the operating efficiency of excavation. And, if the relief set pressure of the relief valve 14 is set at a high pressure, the vehicle body 4 can be lifted up and a strong force of excavation can be obtained.

However, the relief valve in the above mentioned hydraulic circuit is provided to elevate the relief set pressure to a high pressure with a pressurized discharge fluid from an auxiliary pump that is driven by the engine. Thus, if the engine ceases driving, the auxiliary hydraulic pump will also cease discharging the pressure fluid so that the relief set pressure of the relief valve may become a low pressure.

For this reason, if, for example, the relief set pressure is set at an elevated pressure to lift up the vehicle body 4 and the engine is halted for any cause in that state, the relief set pressure of the relief valve 14 will become a low pressure and this will cause the pressure within the retraction pressure chamber 11 of the boom cylinder 6 to be reduced to a low pressure. As a result, an extension operation will occur in the boom cylinder 6 due to the weight of the vehicle body and so forth so that the vehicle body 4 may be dropped.

More specifically, if a retraction operation occurs in the retraction pressure chamber 11 of the boom cylinder 6 when a pressure fluid is supplied therein, the boom 5 will be swung downwards with a supporting point 5*a* at a side of the vehicle body serving as a fulcrum. Then, if the bucket 9 is in contact with the ground surface, the boom 5 will not be able to be swung downwards and will, on the contrary, be swung upwards with a supporting point 5*b* at a side of the arm serving as a fulcrum so that the vehicle body 4 may be lifted up as shown by the phantom line. In that state, if the relief set pressure of the relief valve 14 is reduced to a low pressure, a force of extension due to the weight of the vehicle body 4 will be exerted on the boom cylinder 6 and, as a result, the pressure fluid within the retraction pressure chamber 11 will be allowed to flow out through the relief valve 14 into a reservoir 16. The boom cylinder 6 will then be extension operated, causing the vehicle body 4 to be dropped.

Thus, due to the possibility that the vehicle body may be dropped when the engine is halted, there has been a serious problem as to safety in the prior art.

Also, if the low set pressure of the relief valve 14 is elevated not to cause a drop of the vehicle body 4, a difference with a high set pressure will be reduced, thus giving rise to the problem that an enhancement of the operating efficiency of an excavating operating that is originally sought may not be realized.

With the above mentioned problems taken into account, it is, accordingly, an object of the present invention to provide a hydraulic circuit for a boom cylinder in a hydraulic shovel, which provides a sufficient safety and in which in a state where a vehicle body has been lifted up, there may be no false drop of the vehicle body when the engine is halted.

SUMMARY OF THE INVENTION

In order to achieve the object mentioned above, there is provided in accordance with the present invention, in a first general form of embodiment thereof, a hydraulic circuit for a boom cylinder in a hydraulic shovel in which a pressurized discharge fluid from a hydraulic pump that is driven by an engine, is supplied via a directional control valve for a boom into a retraction pressure chamber and an extension pressure chamber of a boom cylinder for swinging the boom upwards and downwards, characterized in that:

there is provided a relief valve in a circuit for connecting the said retraction pressure chamber of the boom cylinder to the said boom directional control valve, the said relief valve having a relief set pressure; and there is provided a switching means for switching the said relief set pressure to a low pressure as well as to a high pressure if the said directional control valve is set at a position that is other than a neutral position thereof, when the said engine is driven, the said switching means being adapted to switch the said relief set pressure to a high pressure when the said engine is halted.

According to the construction mentioned above, it can be seen that since the said relief valve has its relief set pressure elevated to a high pressure without fail when the engine ceases driving, quite a favorable safety measure is advantageously provided in which where a vehicle body has been lifted up, there can be no false drop of the vehicle body when the engine is halted.

Furthermore, if the relief set pressure is switched to a low pressure, it can be seen that as long as the directional control valve is held at its neutral state, i.e. as long as no excavating operation is being carried out, the relief set pressure will be in a high pressure set state and hence in a state in which a vehicle body has been lifted up, when the engine is being driven there can be no drop of the vehicle body due to any false operation whatsoever.

Also, in the construction mentioned above, it may be desirable that:

the said relief valve should be provided with a set pressure changing section having a pilot chamber;

the said relief valve should be adapted to have the said relief set pressure reduced to a said low pressure when the said pilot chamber is supplied with a pressure fluid and should be adapted to have the said relief set pressure increased to a said high pressure when the said said pilot chamber is not supplied with a said pressure fluid;

there should be provided an auxiliary hydraulic pump having a discharge path and which is driven by the said engine;

the said discharge path should be connected via a switching valve to the said pilot chamber of said relief valve; and there should be provided a controller for setting the said switching valve at a drain position thereof normally and setting the said switching valve at a pressure fluid supply position thereof optionally when the said directional control valve is set at a position that is other than the said neutral position thereof.

Further, in the construction mentioned above, it may be desirable that the said switching valve should be adapted to be set at said drain position thereof normally and to be set at the said supply position thereof when a solenoid therefor is magnetized; and the said controller should be adapted to furnish at an output thereof a signal for magnetizing said solenoid only when said controller is furnished at an input thereof with a low pressure set signal from a set pressure change-over switch and an operation state indicative signal from a directional control valve operation detecting means.

According to the preceding construction, it can be seen that electrically switching the said switching valve will cause the relief set pressure of the said relief valve to be switched to a low pressure as well as a high pressure, thereby facilitating the operation.

Still further, in the construction mentioned above, it may be desirable that the said relief valve should be constituted of: a relief valve body that is adapted to block a communication between an inlet port and an outlet port under a mounting load of a first spring and to establish the communication between the said inlet port and the said outlet port under a pressure at the said inlet port; and a set pressure changing section for increasing the said mounting load of the said first spring when it is pushed by a second spring and for sliding against the said second spring to reduce the said mounting load of the said first spring.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Hereinafter, suitable embodiments of the present invention with respect to a hydraulic circuit for a boom cylinder in a hydraulic shovel will be set forth with reference to the accompanying drawings hereof.

Figure 1:
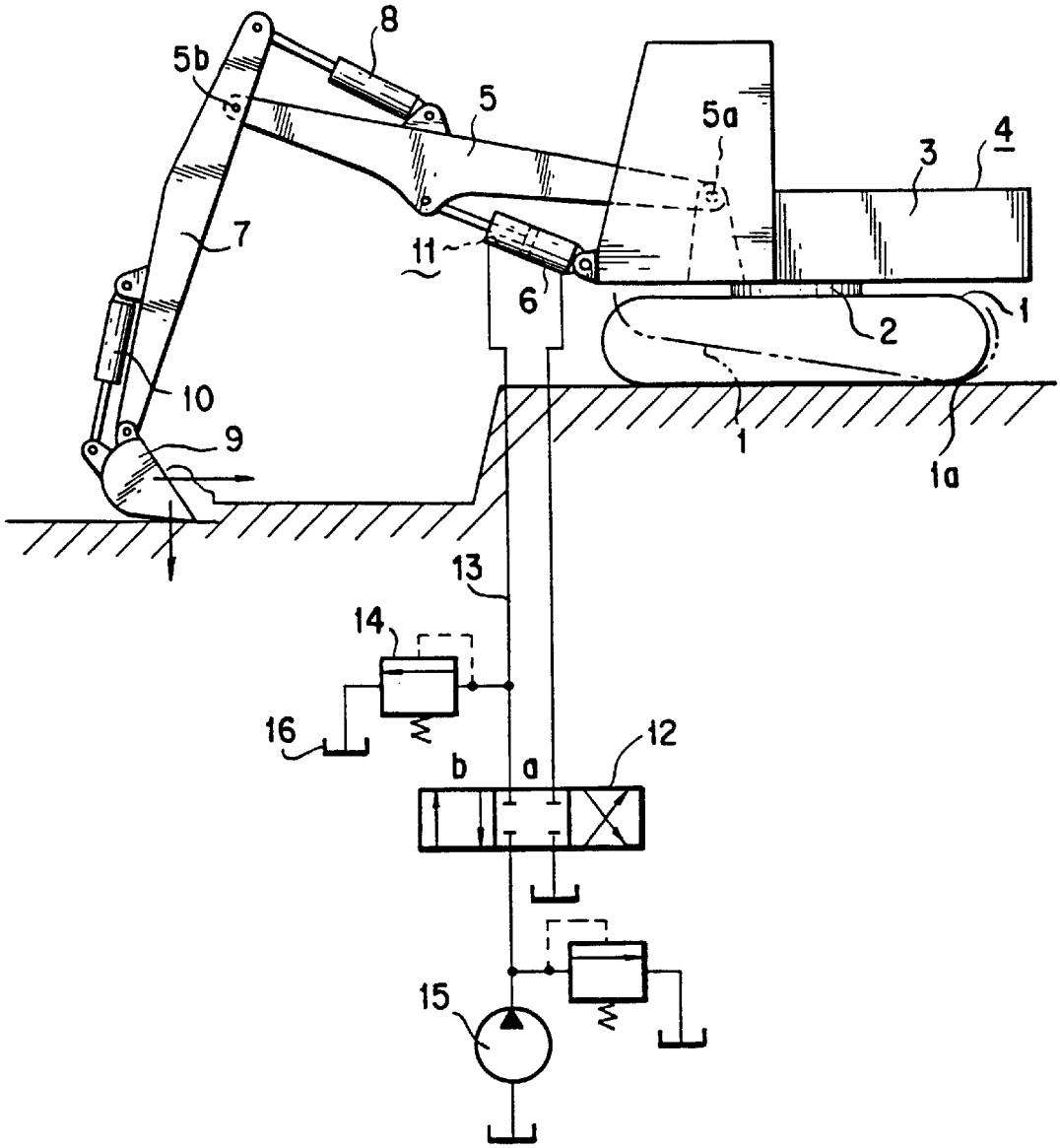
PRIOR ART FIG. 1
FIG. 1 is a constructive explanatory view of all example of the hydraulic circuit in the prior art for a boom cylinder in the conventional hydraulic shovel.
Figure 2:
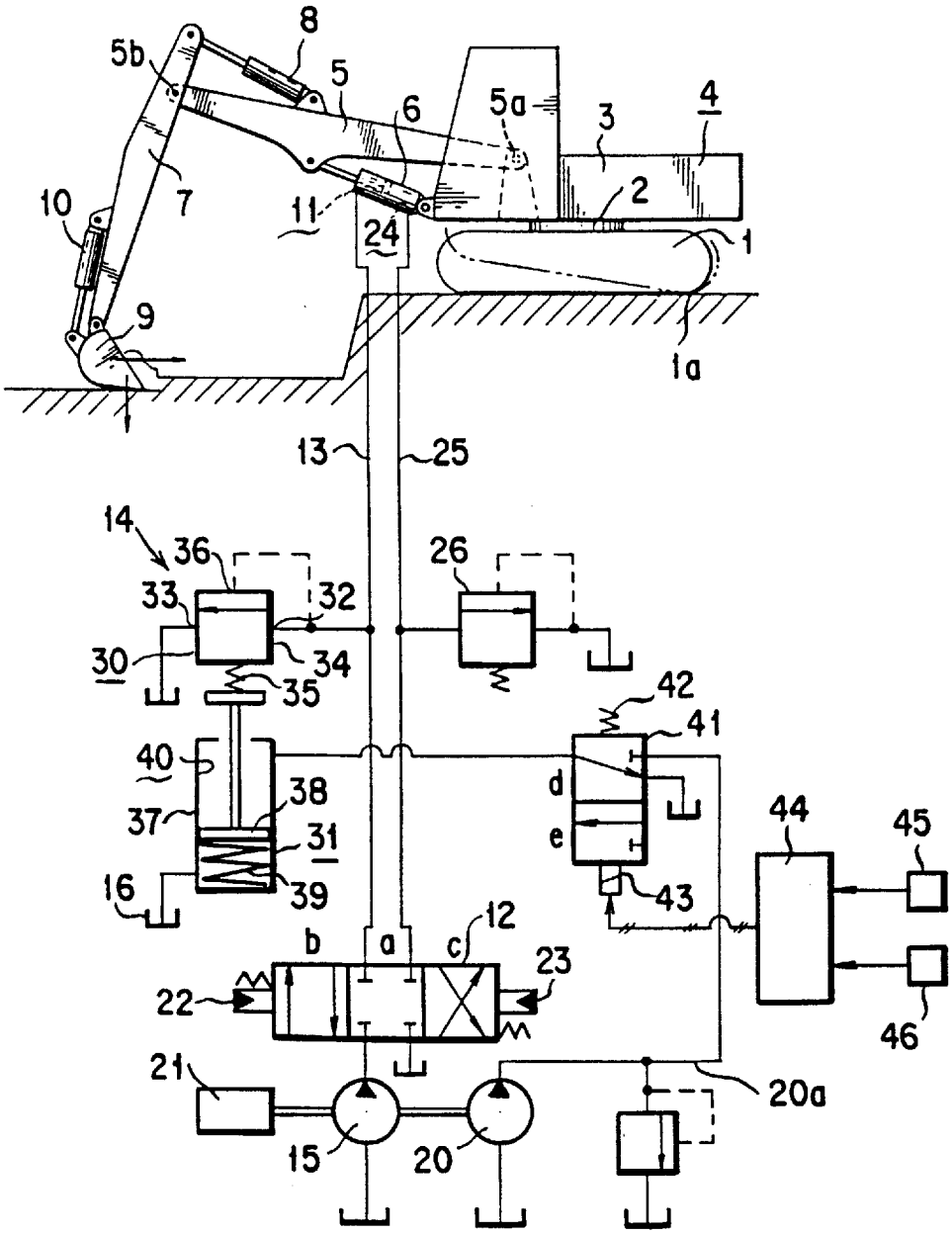
FIG. 2 is a constructive explanatory view of a certain embodiment of the hydraulic circuit for a boom cylinder in a hydraulic shovel, according to the present invention.

An explanation will now be given with respect to a certain embodiment of the present invention with reference to FIG. 2 of the drawings attached hereto.

It should be noted that the same components in the prior art are designated by the same reference numerals.

An auxiliary hydraulic pump 20 and a said hydraulic pump 15 together are driven by a said engine 21. A said boom directional control valve 12 is held at its neutral position a and is adapted to be switched to a retraction position b thereof under a fluid pressure that acts on a first pressure receiving portion 22 and to an extension position c thereof under a fluid pressure that acts on a second pressure receiving position 23. There is provided a relief valve 26 in a second circuit 25 that connects between the said boom directional control valve 12 and an extension pressure chamber 24 of a boom cylinder 6.

A relief valve 14 which is provided in a first circuit 13 that connects between the said directional control valve 12 and a retraction pressure chamber 11 of a boom cylinder 6, is comprised of a relief valve body 30 and a set pressure changing section 31. The said relief valve body 30 has a valve 34 for establishing and blocking a communication between an inlet port 32 and an outlet port 33, a spring 35 that is adapted to thrust the said valve 34 in its blocking direction, and a pressure receiving chamber 36 that is adapted to thrust the said valve 34 in its communicating direction under an inlet pressure. And, the said relief valve body 30 has a relief set pressure established so as to be commensurate with a mounting load for the said spring 35. The said mounting load of the spring 35 is large so that the relief pressure of the relief valve body 30 may remain high.

The above mentioned set pressure changing section 31 is adapted to thrust a piston 38 in a cylinder 37 in an extension direction by a spring 39. The said piston 38 is held in contact with the above mentioned spring 35 of the said relief valve body 30 to maintain the said mounting load large for the said spring 35. A pilot chamber of the said cylinder 37, e.g., a retraction chamber 40 therein, is connected to one of a reservoir and a discharge path 20*a* of the said auxiliary hydraulic pump 20 via a switching valve 41 and is adapted to be controlled thereby.

The above mentioned switching valve 41 is held at its drain position d by a spring 42 and is adapted to be switched to its supply position e when a solenoid 43 therefor is magnetized. The said solenoid 43 is adapted to be magnetized and demagnetized by a controller 44.

The above mentioned controller 44 is adapted to be furnished with a low pressure set signal from a set pressure change-over switch 45, and also to be furnished from a directional control valve operation detecting means 46 with a signal which indicates that the said boom directional control valve 12 has been switched to the said retraction position b or to the said extension position c. The said controller 44, when furnished with the said two signals, is designed to furnish a signal for magnetizing the said solenoid 43 and, when not furnished with the said two signals, is adapted to furnish a signal for demagnetizing the said solenoid 43.

The above mentioned directional control valve operation detecting means 46 can be any means that is capable of detecting with a pair of pressure switches or the like the fluid pressures that act on a first pressure receiving portion 22 and a second pressure receiving portion 23, respectively, furnishing directly into the said controller 44 the fluid pressures that act on the said first and second pressure receiving portion 22 and 23, respectively, detecting with a pair of switches the operations of a pair of pilot valves for supplying a pressure fluid into the said first and second pressure receiving portions 22 and 23, respectively, or detecting with a pair of switches that the said boom directional control valve 12 has been operatively switched to the retraction position b and the extension position c, respectively.

Now, an explanation will be given with respect to the operation of the above mentioned embodiment of the present invention.

If a low pressure signal is furnished from the said set pressure change-over switch 45 into the said controller 44 while an excavating operation is being carried out with the said boom directional control valve 12 set to either the said retraction position b or the said extension position c, the said solenoid 43 will be magnetized to set the said switching valve 41 at the said supply position e. The pressurized discharge fluid of the said auxiliary hydraulic pump 20 (i.e. a pilot pressure fluid) will thereby be supplied into the said retraction pressure chamber 40 of the cylinder 37 of the said set pressure changing section 31 to operatively retract its piston rod 38, which will no longer act to push the said spring 35. When the said mounting load for the spring 35 is then reduced, the said relief set pressure of the relief valve body 30 will be reduced to a low pressure.

This being the case, since the pressure within the said retraction pressure chamber 11 of the cylinder 6 during an excavating operation can only be elevated up to the relief set pressure of the said relief valve 14 which is a low pressure, there can be no situation in which the said boom 5 will no longer be swung downwards and the said boom 5, the said arm 7 and the said bucket 9 will cease moving.

On the other hand, if a low pressure set signal is not furnished from the said set pressure change-over switch 45 to the said controller 44 during the above mentioned excavating operation, the said solenoid 43 will be demagnetized so that the said switching valve 41 may take the said drain position d, thus permitting the pressure fluid in the retraction pressure chamber 40 of the said pressure changing section 31 to flow out into the reservoir. Since the said mounting load of the said spring 35 is then increased, the said relief set pressure of the relief valve body 30 will be elevated to a high pressure and the said relief set pressure 14 of the relief valve 14 will thereby be elevated to a high pressure.

In this state, since the pressure within the said retraction pressure chamber 11 of the boom cylinder 6 can thereby be elevated to a high pressure, the said boom cylinder 6 will be retraction operated so that the vehicle body 4 may be lifted up and a strong force of excavation may be obtainable.

Also, since the said boom directional control valve 12 takes the said neutral position a in a state in which the said vehicle 4 has been lifted up, it can be seen that if a low pressure set signal is furnished from the said set pressure change-over switch 45 to the controller 44, there will be no magnetization of the said solenoid 43 by the said controller 44 and since the said relief valve 14 is held in a high pressure set state, no false operation whatsoever may cause a drop of the vehicle body 4.

The above mentioned directional control valve operation detecting means 46 can be a means that is designed to detect that the said boom directional control valve 12 and the arm directional control valve have each been set at a position other than the neutral position a, or in addition designed to detect that the bucket directional control valve has been set at a position other than its neutral position.

Stated otherwise, the said directional control valve operation detecting means 46 may be a means that is designed to detect that an excavating operation is being performed with at least one of the said boom 5, the said arm 7 and the said bucket 9 operated.

Also, if the said engine 21 is halted in a state in which the said vehicle body 4 has been lifted up, no pressure fluid will be discharged from the said auxiliary hydraulic pump 20. Then, if the said switching valve 41 is set to take its supply position e, no pressure fluid will be supplied into the said retraction pressure chamber 40 of the cylinder 37 of the said set pressure changing section 31. Thus, with the said relief set pressure of the relief valve 14 being not reduced to a low pressure but elevated to a high pressure, there can be no drop of the said vehicle body 4.

An explanation will now be given with respect to certain specific structures of the said relief valve according to the present invention.

Figure 3:
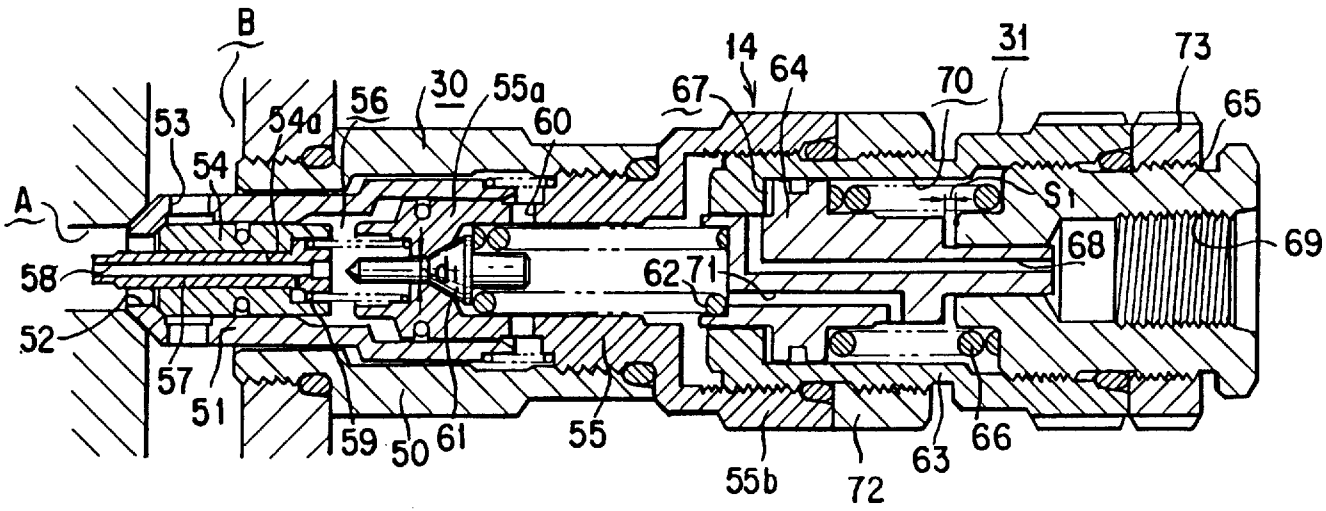
FIG. 3 is a cross sectional view illustrating a first example of the specific structure of a relief valve that can be used in the above mentioned embodiment of the present invention.

FIG. 3 shows one example thereof. As shown, a first cylindrical body 51 is inserted into a first sleeve 50 and is secured thereto. The said first cylindrical body 51 is formed with an inlet port 52 and an outlet port 53, with the said inlet port 52 being open to a high pressure side A and the said outlet port 53 being open to a low pressure side B.

A main valve 54 is slidably fitted in the above mentioned first cylindrical body 51 for establishing and blocking a communication between the said inlet port 52 and the said outlet port 53. A second sleeve 55 that is threadedly mated with the above mentioned first sleeve 50 and is secured thereto has its forward end that is fitted in the said first cylindrical body 51 to form a pressure receiving chamber 56 between itself and the said main valve 54. The said pressure receiving chamber 56 communicates with the said high pressure side A through an axial bore 58 of a rod body 57 that is slidably fitted in the said main valve 54, which is designed to be energized by a spring 59 towards its blocking position.

A poppet 61 is fitted in the above mentioned second sleeve 55 for establishing and blocking a communication between the said pressure receiving chamber 56 and a drain port 60. The said poppet 61 is energized in its blocking position by a spring 62.

The components here constitute the said relief valve body 30.

In the said relief valve body 30, the said poppet 61 is adapted to be pushed in its communicating direction under a force that is a product of a pressure receiving area that is defined by a seat diameter $d_1$ and a hydraulic pressure that acts on the said pressure receiving area. Since it is pushed in its blocking direction under a mounting load of the said spring 62, it can be seen that if the pressure within the said pressure receiving chamber 56 is elevated so that the said force may exceed the said mounting load of the spring 62, the said poppet 61 will be pushed in its communicating direction. Thus, the pressure fluid at the high pressure side A will be caused to flow through the said drain port 60 into the said low pressure side B and, as a result, the pressure within the said pressure receiving chamber 56 will be made lower than that at the said high pressure side so that the said main valve 54 may be slided in a direction such that the said inlet port 52 and the said outlet port 53 may communicate with each other, and may play a relief function.

Here, it should be noted that the above mentioned relief valve body 30 is determined by the product of the pressure receiving area that is defined by a seat diameter $d_1$ of the said poppet 61 and the hydraulic pressure acting on the said pressure receiving area and the mounting load of the said spring 62. Thus, the smaller the mounting load of the spring 62, the lower will be the said relief set pressure. Also, the longer the mounting length of the spring 62, the smaller will be the said mounting load of the said spring 62. Further, the greater the the mounting load of the said spring 62, the higher will be the relief set pressure of the above mentioned relief valve 62. And, the shorter the mounting length, the greater will be the mounting load of the said spring 62.

In the above mentioned second sleeve 55 there is a third sleeve 63 threadedly mated therewith and secured thereto. In the said third sleeve 63, there are a piston 64 slidably fitted and a plug 65 threadedly mated therewith and secured thereto. The said piston 64 is held in contact with the above mentioned spring 62 and is adapted to be pushed by a spring 66 in its projecting direction (i.e. leftwards as shown in FIG. 3). A pressure receiving chamber 67 that is adapted to displace the said piston 64 in its retracting direction (i.e. rightwards as shown in FIG. 3), is arranged to communicate with a port 69 in the said plug 65 through an internal passage 68.

The above mentioned port 69 of the said plug 65 can be selectively connected with one of a pilot hydraulic pressure source and a reservoir. For example, it can be selectively connected via the said switching valve 41 with one of the said auxiliary hydraulic pump 20 and the said reservoir 16 in FIG. 2.

The components constitute the above mentioned set pressure changing section 31.

An explanation will now be given with respect to the operation of the above mentioned relief valve 14.

(when the pressure receiving chamber 67 is arranged to communicate with the reservoir):

The said piston 64 will be thrusted leftwards by the said spring 66 to compress the said spring 62 and thereby to shorten the set length of the spring thereof. Then, the said spring 62 will have its mounting load enlarged and will elevate the relief set pressure of the said relief valve body 30 to a high pressure.

(when the pressure receiving chamber 67 is supplied with a pressure fluid):

When the pressure within the said pressure receiving chamber 67 has reached a pressure such that a force which is the product of the said pressure and the said pressure receiving area may be made greater than the said mounting load of the said spring 66, the said piston 64 will be thrusted rightwards against the said spring 66 until it makes an abutment on the said plug 65. Since the set length of the said spring 62 wilt then be increased and the mounting load of the said spring 62 will thereby be reduced, the relief set pressure of the said relief valve body 30 will become a low pressure. It follows then that the fluid within a spiring chamber 70 will be allowed to flow out through an internal drain path 71 and the said drain port 60 into a reservoir.

It should be noted at this point that the above mentioned third sleeve 63 can be tightened and loosened by when a lock nut 72 is loosened. Since the mounting load of the said spring 62 is thereby increased and decreased, the said relief pressure that is high can be adjusted by tightening and loosening the said third sleeve 63 to adjust the said mounting load of the said spring 62.

Also, the displacement $S_1$ of the said piston 64 can be reduced if the said lock nut 72 is loosened and the said plug 65 is tightened. The displacement $S_1$ of the said piston 64 can be enlarged if the said plug 65 is loosened. Hence, the low pressure can thereby be adjusted.

Figure 4:
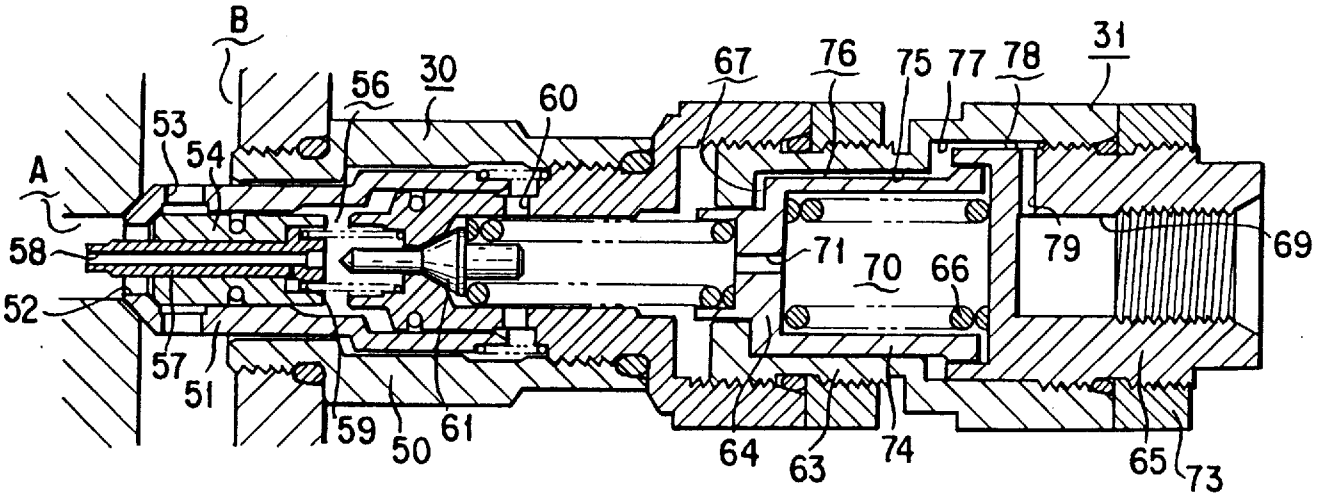
FIG. 4 is a cross sectional view illustrating a second example of the specific structure of a relief valve that can be used in the above mentioned embodiment of the present invention.

FIG. 4 shows a second embodiment of the specific structure of the said relief valve 14 in which a said piston 64 is made cylindrical and a said pressure receiving chamber 67 is arranged to communicate with a said port 69 through a gap 76 that is constituted with a slit slot 75 formed between an inner circumferential surface of a said third sleeve 63 and a piston cylindrical portion 74, a gap 78 between a slit slot 77 formed in an inner circumferential surface of the said third sleeve 63 and a peripheral surface of a said plug 65, and a bore 79 in the said plug 65.

As set forth in the foregoing description, according to a hydraulic circuit for a boom cylinder in a hydraulic shovel provided in accordance with the present invention, it can be seen that since the said relief valve has its relief set pressure elevated to a high pressure without fail when the engine ceases driving, quite a favorable safety measure is advantageously provided in which where a vehicle body has been lifted up, there can be no false drop of the vehicle body when the engine is halted.

Also, with the said switching valve being switched electrically, it can be seen that the relief set pressure of the said relief valve will be switched to a low pressure as well as a high pressure, thereby facilitating the operation.

Furthermore, if a low pressure set signal is furnished from the said set pressure change-over switch, it can be seen that as long as no excavating operation is being carried out, the relief set pressure of the said relief valve will be maintained at a high pressure, and in a state in which a vehicle body has been lifted up there can be no drop of the vehicle body due to a false operation or a stoppage of the engine whatsoever.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A hydraulic circuit for a boom cylinder in a hydraulic shovel in which a pressurized discharge fluid from a hydraulic pump which is driven by an engine of the shovel is supplied via a directional control valve for a boom into a retraction pressure chamber and an extension pressure chamber of a boom cylinder for swinging the boom upwards and downwards, said hydraulic circuit comprising:

a relief valve in a circuit for connecting said retraction pressure chamber of the boom cylinder to said directional control valve, said relief valve having a relief set pressure; and a switching means for switching said relief set pressure to a low pressure as well as to a high pressure according to an operational condition when the engine is driven and the directional control valve is set at a position other than a neutral position thereof, said switching means comprising an electromagnetic element adapted to switch said relief set pressure to a high pressure when said engine is halted.

2. A hydraulic circuit for a boom cylinder in a hydraulic shovel as set forth in claim 1 in which:

said relief valve is provided with a set pressure changing section having a pilot chamber;

said relief valve is adapted to have said relief set pressure reduced to said low pressure when said pilot chamber is supplied with a pressure fluid and is adapted to have said relief set pressure increased to said high pressure when said pilot chamber is not supplied with a said pressure fluid;

an auxiliary hydraulic pump having a discharge path and which is driven by said engine;

said discharge path is connected via a switching valve to said pilot chamber of said relief valve; and a controller for setting said switching valve at a drain position d thereof when said directional control valve is set at said neutral position and setting said switching valve at a pressure fluid supply position when said directional control valve is set at a position other than said neutral position thereof.

3. A hydraulic circuit for a boom cylinder in a hydraulic shovel as set forth in claim 2, in which:

said switching valve is adapted to be set at said drain position thereof when said solenoid therefor is demagnetized and to be set at said supply position thereof when said solenoid therefor is magnetized; and said controller is adapted to furnish at an output thereof a signal for magnetizing said solenoid only when said controller is furnished at an input thereof with a low pressure set signal from a set pressure change-over switch and an operation state indicative signal from a directional control valve operation detecting means.

4. A hydraulic circuit for a boom cylinder in a hydraulic shovel as set forth in either claim 2 or claim 3 in which said relief valve comprises:

a relief valve body adapted to block a communication between an inlet port and an outlet port under a mounting load of a first spring and to establish the communication between said inlet port and said outlet port under a pressure at said inlet port; and a set pressure changing section for increasing said mounting load of said first spring when it is pushed by a second spring and for sliding against said second spring to reduce said mounting load of said first spring.

5. A hydraulic circuit for a boom cylinder in a hydraulic shovel as set forth in claim 2, in which:

said switching valve is adapted to be set at said drain position thereof when said solenoid therefor is demagnetized and to be set at said supply position thereof when said solenoid therefor is magnetized; and said controller is adapted to furnish at an output thereof a signal for magnetizing said solenoid only when said controller is furnished at an input thereof with a low pressure set signal from a set pressure change-over switch and an operation state indicative signal from a directional control valve operation detecting means.

6. A hydraulic circuit for a boom cylinder in a hydraulic shovel in which a pressurized discharge fluid from a hydraulic pump which is driven by an engine of the shovel is supplied via a directional control valve for a boom into a retraction pressure chamber and an extension pressure chamber of a boom cylinder for swinging the boom upwards and downwards, said hydraulic circuit comprising:

a relief valve disposed in a circuit for connecting said retraction pressure chamber of the boom cylinder to said directional control valve, said relief valve having a relief set pressure;

a switching means for switching said relief set pressure to a low pressure and a high pressure when said directional control valve is set at a position other than a neutral position thereof, when the engine is driven, said switching means being adapted to switch said relief set pressure to a high pressure when the engine is halted, wherein said relief valve is provided with a set pressure changing section having a pilot chamber and adapted to have the relief set pressure reduced to the low pressure when the pilot chamber is supplied with a pressure fluid and adapted to have the relief set pressure increased to the high pressure when the pilot chamber is not supplied with the pressure fluid;

an auxiliary hydraulic pump having a discharge path and driven by the engine, said discharge path being connected to the pilot chamber through a switching valve; and a controller for setting the switching valve at a drain position thereof when said directional control valve is set at said neutral position and setting the switching valve at said pressure fluid supply position when the directional control valve is set at position other than the neutral position thereof.

7. A hydraulic circuit for a boom cylinder in a hydraulic shovel as set forth in either claim 5 or 6 wherein said relief valve comprises:

a relief valve body adapted to block a communication between an inlet port and an outlet port under a mounting load of a first spring and to establish the communication between said inlet port and said outlet port under a pressure at said inlet port; and a set pressure changing section for increasing said mounting load of said first spring when pushed by a second spring and for sliding against said second spring to reduce said mounting load of said first spring.

* * * * *